United States Patent [19]

Robinson

[11] Patent Number: 4,619,751

[45] Date of Patent: Oct. 28, 1986

[54] ANODE INSULATOR FOR ELECTROLYTIC CELL

[76] Inventor: Douglas J. Robinson, 8832 E. Holmes, Tucson, Ariz. 85710

[21] Appl. No.: 726,507

[22] Filed: Apr. 24, 1985

[51] Int. Cl.[4] ..... C25C 7/04

[52] U.S. Cl. ..... 204/267; 204/279; 204/286

[58] Field of Search ..... 204/279, 280, 267, 297 R, 204/286–289

[56] References Cited

U.S. PATENT DOCUMENTS

| | | | |
|---|---|---|---|
| 3,579,431 | 5/1971 | Jasberg | 204/280 X |
| 3,796,648 | 3/1974 | Conner, Jr. et al. | 204/286 |
| 3,960,698 | 6/1976 | Bortak | 204/267 |
| 3,975,255 | 8/1976 | Kircher | 204/252 |
| 3,997,421 | 12/1976 | Perri et al. | 204/297 R |
| 4,014,775 | 3/1977 | Kircher et al. | 204/252 |
| 4,173,525 | 11/1979 | Nakamatsu et al. | 204/275 |
| 4,174,259 | 11/1979 | Rucker et al. | 204/252 |
| 4,279,731 | 7/1981 | Pellegri | 204/254 |
| 4,368,109 | 1/1983 | Ford | 204/253 |
| 4,374,014 | 2/1983 | Smith et al. | 204/260 |
| 4,377,462 | 3/1983 | Baker et al. | 204/253 |
| 4,399,020 | 8/1983 | Branchick et al. | 204/279 X |

FOREIGN PATENT DOCUMENTS

| | | | |
|---|---|---|---|
| 970718 | 7/1975 | Canada | 204/209 |

*Primary Examiner*—Donald R. Valentine

*Attorney, Agent, or Firm*—Cahill, Sutton & Thomas

[57] ABSTRACT

A plastic insulator extending around and conforming to the shape of a header bar supporting a lead electrowinning anode includes legs that extend from the top of the header bar downward along the opposite faces of the anode to a level below the bottom edge of the anode, whereat the lower ends of the legs are joined. The upper, outer side surfaces of the insulator are sloped to prevent shorting of cathodes with the anode header bar during loading and removal of the cathodes. In one described embodiment of the invention, the insulator is hairpin-shaped with the lower ends thereof joined by a plastic retaining pin. In another embodiment of the invention, a U-shaped lower section is attached in a telescoping fashion to the lower ends of the legs of the insulator. In one embodiment of the invention, an upper portion of the insulator extends substantially above the top of the anode header bar to guide cathodes between the anodes during loading and removal of the cathodes.

10 Claims, 12 Drawing Figures

ANODE INSULATOR FOR ELECTROLYTIC CELL

BACKGROUND OF THE INVENTION

The invention relates to plastic insulators that are attached to anodes used in electrowinning cells, to ensure precise and positive separation at all times between the anodes and the adjacent cathodes, including during loading and removal of the cathodes, and also to prevent shorting between intermediate portions of the anodes and warped portions of the cathodes.

An electrowinning facility, particularly the type used for copper electrowinning, includes a large number of cells, typically 20 to 300. Typically, there are 25 to 80 equally spaced anodes in each cell, and a like number of cathodes alternately positioned between the anodes. The anodes are composed of lead, which may be about one-fourth of an inch to three-fourths of an inch thick, about 32 to 36 inches wide, and about 36 to 60 inches high, and weigh roughly in the range of 110 pounds to 700 pounds. They are spaced on about two inch centers in the electrowinning cell. The upper edge of a lead anode is typically soldered in a slot in a copper header bar, or may be welded to the header bar coated with lead. The cathodes consist of very thin sheets of copper which are only about one thirty-secondth of an inch thick, supported on copper cathode header bars. The electrowon copper is deposited on the thin cathode sheets, which periodically are lifted out of the electrowinning cell to harvest the copper, and then another set is reloaded into the cell. Because of the thinness and fragileness of the cathode sheets, warping of the cathodes is a very common problem. Such warping leads to electrical shorts between the anodes and cathodes, reducing the efficiency of the copper recovery process and increasing the amount of electrical current consumed by the process. These problems are well known in the copper electrowinning industry. Numerous attempts have been made to solve the problems. Decreasing the average spacing between anodes and cathodes increases the electrode efficiency of an electrowinning cell, but the extent to which this can be done is limited by losses in efficiency caused by consequent shorting between cathodes and anodes. To avoid such shorting, various insulators, have been proposed. One type of insulator extends downward along the length of the lead anodes. Use of this technique is time-consuming and expensive. With this device, each lead anode has to be removed from the cell, appropriate holes drilled through it, and pins or screws must be passed through the insulator and the holes in the anode to permanently fix the insulator elements to the opposed faces of the lead anode. U.S. Pat. No. 3,997,421 teaches use of spring loaded plastic clips that are attached to the bottom edges of the anodes. U.S. Pat. No. 3,997,421 illustrates an insulator that fits over the copper header bar and has pointed, symmetrical upper surfaces which tend to guide cathodes as they are being lowered into the cell between their respective anodes, and thereby avoid rubbing of lead coating from the anode header bar onto the copper sheets of the cathode. In the past, copper refining plants using soluble, impure copper anodes often have made use of three-eighths inch PVC pipe bent into the shape of a hairpin and draped over the top of the anode. Such anodes have no header bar. Such "hairpin" insulators generally extend downward to a level below the lower edge of the anode, and have breather holes at the top. They are normally unconnected at their lower ends, and thus do not form a closed loop around the body of the anode. Such hairpin insulators are draped over the soluble copper anode immediately after it is placed in a refining cell. The anode rapidly dissolves over a three to four week period of time. Then, the hairpin insulator is removed, the remnants of the old anode are removed, and a new soluble copper anode is positioned in the refining cell to replace the old one, and the hairpin insulators are again draped over the new anode. Those skilled in the art will appreciate that as a practical matter there is a great difference between the foregoing copper refining process and a copper electrowinning process. The refining process is one in which the copper in the impure anodes is electrotypically placed into solution and plated out with much higher purity onto adjacent cathodes, whereas in an electrowinning process copper is already in solution as a result of prior leaching process. The purpose and operation of an electrowinning cell is to electrotypically win the metal from the solution. In a refining cell, both the anodes and the cathodes are composed of copper; whereas in an electrowinning cell, the anode is made of a lead alloy, and the cathode is composed of electrowon copper. In electrowinning operations, there can be substantial loss of purity of the deposited copper cathode as a result of rubbing of the copper cathodes against the lead anodes during removal or insertion of the cathodes into the electrowinning cell.

Thus, an entirely different set of considerations apply to design of anode insulators for copper refining cells than for copper electrowinning cells.

Another type of commercially available anode insulator which is used in copper electrowinning cells is a similar hairpin shaped plastic tube which is inserted through a hole near the upper edge of the anode beneath the anode header bar. This insulator extends downward to a level slightly below the lower edge of the anode, and is often held in place by binding the legs together with wire, tape, or rubber bands. This insulator does not prevent contact of the cathode with the lead coating of the anode header bar, and moreover, installation of this type of anode insulator requires removal of the anode, drilling of the holes required. None of the above-described anode insulators completely solves the problems associated with close spacing of anodes and cathodes, none solves the problems caused by warping of the cathodes during cell operation, and none reliably avoids contamination of the cathodes by preventing contact with the lead of the anode or the lead coating of the anode header bar during cell operation and during loading and removal of the cathode. There remains an unmet need for an economical, reliable, easily installed insulator that substantially solves all of these problems.

SUMMARY OF THE INVENTION

Briefly described, and in accordance with one embodiment thereof, the invention provides a full length insulator that surrounds and conforms to the shape of the the anode header bar and has two legs that extend downward from the header bar along the full length of the anode, and are joined beneath the anode, thereby preventing excessive sideways displacement of the bottom of the insulator during removal of electrowinning cathodes and providing accurate and reliable separation of the anodes from the cathodes during operation of the electrowinning cell, during loading of cathodes into the cell, and during removal of cathodes from the cell. The insulators also prevent contamination resulting from contact between the cathodes and anode header bar surfaces and anode surfaces during loading of the cathodes. In one described embodiment of the invention, the bottom sections of the insulator legs are joined beneath the bottom edge of the anode by plastic pins that snap fit onto the legs to tie the lower ends of the insulator legs together. In another embodiment of the invention, a U-shaped lower section has legs that join in a telescoping fashion with the lower ends of the insulator legs. In another described embodiment of the invention, an upper guide section extends above the anode header bar to a level higher than the highest portion of the anode header bar to serve as a guide for the cathodes during loading and unloading thereof, thereby preventing contamination of the cathode due to contact of the cathodes with the anode and/or lead covered anode header bar during loading or unloading of the cathodes. The outer surfaces of the insulator are smooth, and their upper and lower sides are sloped, to avoid any snagging of the edges of the cathodes with the insulators during loading or removal of the cathodes. The described structures allow the insulators to be easily installed on anodes that have already been loaded into an electrowinning cell. It is also convenient to install the described insulators on anodes that have been hung in a rack prior to being crane loaded into an electrowinning cell. The described insulators are hollow. Breather holes are provided therein to allow air to escape as the electrowinning solution fills the hollow interiors as the anodes are lowered into the solution.

DESCRIPTION OF THE INVENTION

Figure 1:
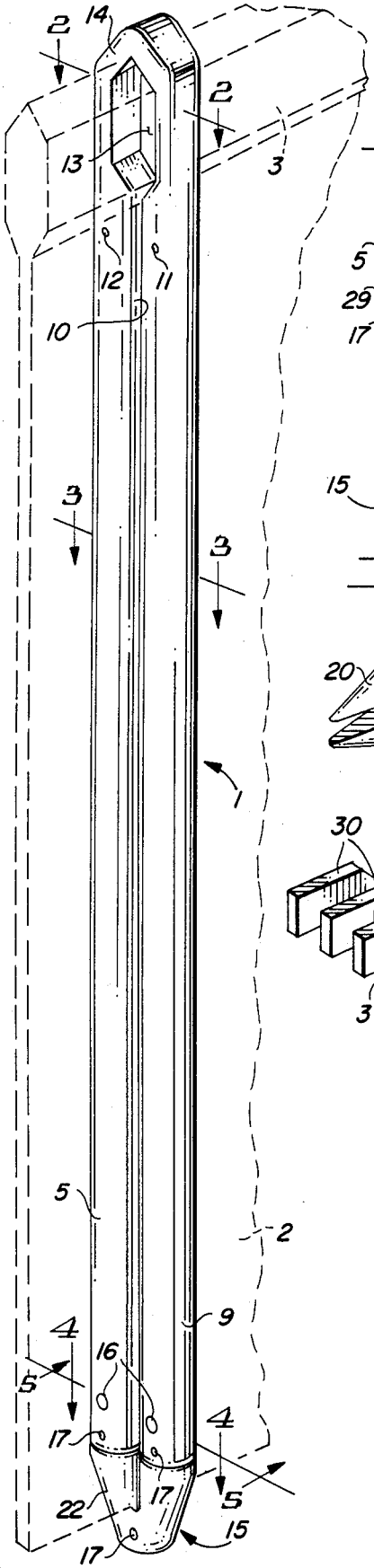
FIG. 1 is a perspective view of one embodiment of the invention.
Figure 2:
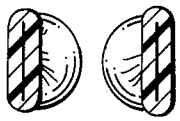
FIG. 2 is a section view taken along section line 2—2 of FIG. 1.
Figure 3:
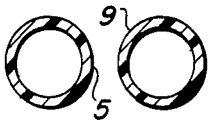
FIG. 3 is a section view taken along section line 3—3 of FIG. 1.
Figure 4:
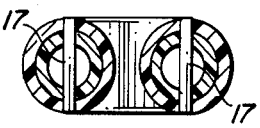
FIG. 4 is a section view taken along section line 4—4 of FIG. 1.
Figure 5:
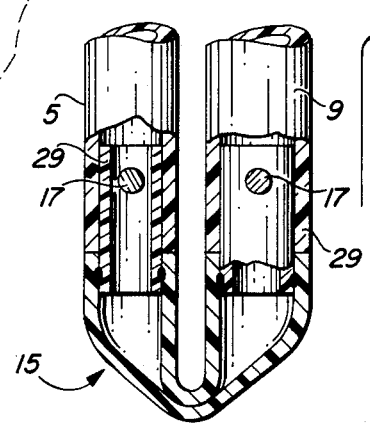
FIG. 5 is a section view taken along section line 5—5 of FIG. 1.

Referring now to the drawings, especially FIGS. 1–5, two, three, or four plastic anode insulators 1 are fitted in the manner illustrated in FIG. 1 to an anode assembly including a typical lead anode 2 supported by an anode header bar, which usually is copper coated with lead.

Anode insulator 1 includes two elongated legs 5 and 9 which extend along either face of lead anode 2. A lower section 15, which is generally U-shaped, loops around the bottom edge of anode 2 and has its upper portions attached to the bottom portions of anode insulator legs 5 and 9, respectively. Legs 5 and 9 are joined at their upper ends to form a hairpin structure having an enlarged opening 13 that conforms closely to the shape of header bar 3.

In one presently preferred embodiment of the invention, the legs 5 and 9 in the upper loop structure are formed of ordinary three-quarter inch PVC schedule 40 water pipe. The structure is made by heating an appropriate length of PVC pipe, placing its midpoint against a suitable first form, quickly bending the pipe around the first form while the PVC pipe remains hot, and forcing a second "envelope" form over the structure to properly shape the outer and inner surfaces of the PVC material forming the loop 14 so that the inner surfaces of the PVC tube conform to the shape of the header bar, and the outer surfaces of the PVC material are all vertical and continuous with the vertical surfaces of the legs 5 and 9, as shown in FIG. 1.

Lower U-shaped bottom section 15 is formed by attaching smaller diameter PVC pipe sections 29 (FIG. 5) having an outside diameter equal to the inside diameter of the PVC pipe of which legs 5 and 9 are composed, and using the smaller diameter PVC pipe sections as pegs that extend telescopically into both the lower ends of legs 5 and 9 and the upper ends of U-shaped bottom section 15. Suitable glue can be used, or else pins such as 17 can be used, enabling the bottom section 15 to be attached easily to the lower ends of legs 5 and 9 after the upper hairpin section of the insulator 1 has been slipped over the header bar 3 and the legs 5 and 9 are slid downward to the position shown in FIG. 1.

Suitable holes such as 16 allow fluid to fill up the inside of the legs 5 and 9. When the legs 5 and 9 are lowered into the electrowinning solution, vent holes 11 and 12 in the upper portions of legs 9 and 5, respectively, allow air to escape as the electrowinning solution fills up the hollow interiors of the anode insulator legs. However, it is not essential that the holes be provided to allow solution to enter the insulators and allow air to escape.

Referring again to FIG. 1, sloped or curved surfaces such as 22 are intentionally provided on lower section 15 in order to prevent any likelihood of the lower edges of warped cathodes being snagged on the lower portion of the anode insulator 1 as the cathodes are lifted out of the electrowinning cell to harvest the deposited copper therefrom.

Figure 6:
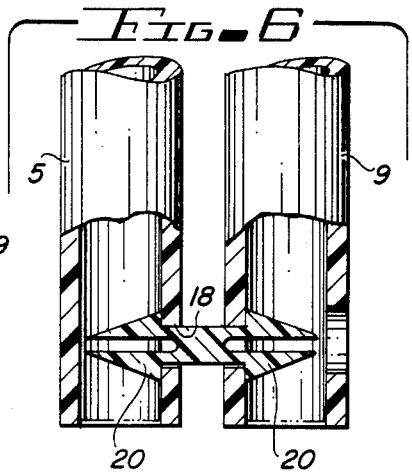
FIG. 6 is a partial cutaway view of an alternate lower section for the anode insulator of the invention.
Figure 7:
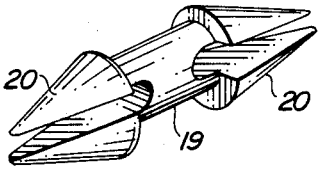
FIG. 7 is a perspective view of a connecting pin used in the embodiment of the invention shown in FIG. 6.

FIG. 6 shows an alternate bottom section in which the lower ends of legs 5 and 9 extend below the bottom edge of the lead anode 2. Instead of using a bottom section 15 as in FIG. 1, holes 18 are drilled through the bottom of the legs 5 and 9, and a retaining pin 19 (FIG. 7) is forced through the retaining holes 18. Wings or clips 20 are forced through the inner sides of the holes 18 and 19, and snap outwardly to securely fasten the lower ends of legs 5 and 9 together, as shown in FIG. 6.

Figure 8:
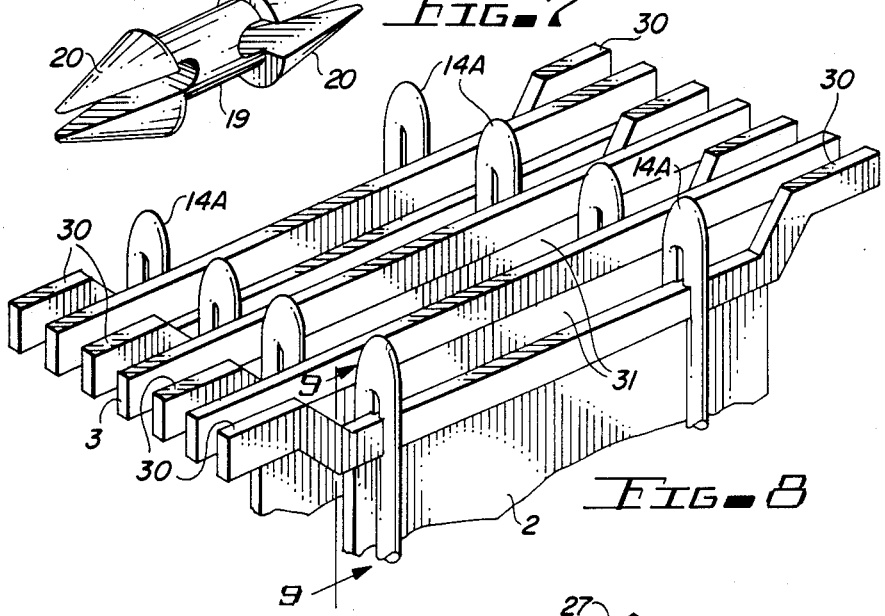
FIG. 8 is a partial perspective view illustrating placement of alternatively spaced anodes and cathodes and the header bars suspending them in a typical electrowinning cell.
Figure 9:
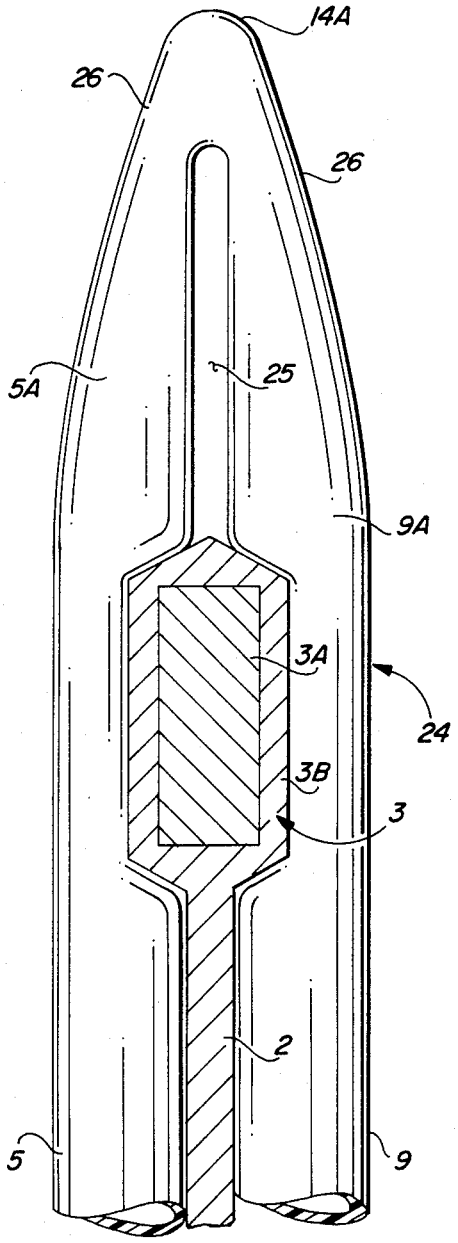
FIG. 9 is a partial elevation view of an alternate upper section of the anode insulators shown in FIG. 8.

Referring next to FIGS. 8 and 9, an alternate upper section 24 that can be used for the anode insulator 1 is shown. Reference numerals 5 and 9 designate the anode insulator legs, as in FIG. 1. Reference numeral 3 generally designates the anode header bar. Reference numeral 3A designates a copper core of the header bar 3, and reference numeral 3B designates a lead coating that often is used on anode header bars for electrowinning copper. Reference numeral 14A designates a raised loop that extends considerably further above the anode header bar 3 than is the case for the anode insulator 1 shown in FIG. 1. Reference numeral 25 designates an elongated, narrow gap between the upper side portions 5A and 9A. Reference numerals 26 designate a steep slope provided on the upper surface of upper portion 24 of the illustrated insulator. The purpose of the raised upper portion 24 is to provide a smooth guide that extends above the highest levels 30 of the anode header 3, as shown in FIG. 8. The sloped surfaces 26 guide the lower edges of the cathodes 31 between the spaced adjacent anodes as the anodes are loaded into the electrowinning cell, thereby preventing the cathodes from rubbing off any of the lead coating 3B of anode header bar 3. This structure is useful for those anode header bars which have raised end portions 30, as shown in FIG. 8. The peaks 14A extend above the highest point of the raised end regions 30 of the anode header bar (which rest on the contact rails of the electrowinning cell).

Figure 11:
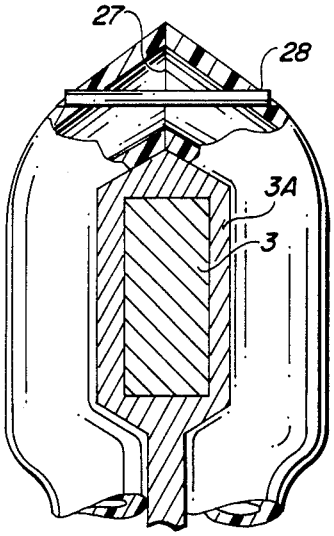
FIG. 11 is an enlarged partial cutaway view of detail 11 of FIG. 10.
Figure 10:
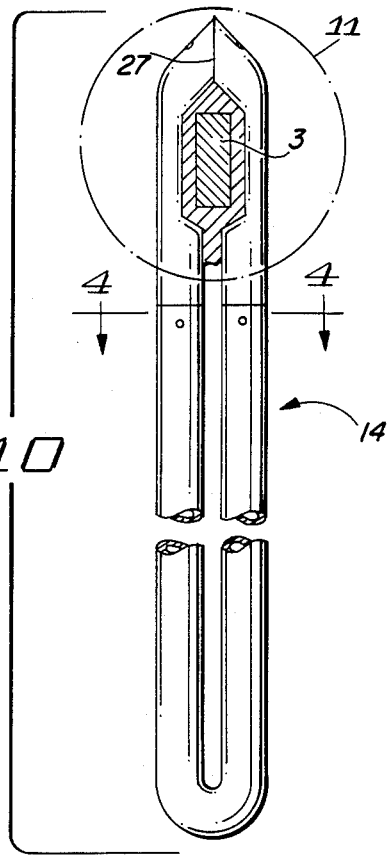
FIG. 10 is a partial elevation view showing another embodiment of the invention.

FIGS. 10 and 11 disclose another variation on the anode insulator of the present invention, wherein the upper portion of an anode insulator 1A is split, as indicated by split line 27. A suitable pin 28 extends through the opposed sides of the loop extending around the header bar, and locks the upper portions of the anode insulator 1A together. This embodiment of the invention may be more convenient than other embodiments of the invention to install on certain anodes while they remain in an electrowinning cell.

All of the above-described embodiments of the invention have certain benefits and advantages, the main advantages being that with two or three of the described anode insulators installed on each anode, the likelihood of any shorting or rubbing between cathodes during loading or removal of them into the electrowinning cell is greatly minimized, even if they are quite warped. This leads to elimination of electrical shorting and avoids the waste of electrical current which inevitably results from such shorting. Copper electrowinning facilities that have utilized this device have reported a decrease in the total current used by the facility of as much as approximately 15 percent.

Each of the described embodiments of the anode insulators of the present invention provide reliable separation and protection against shorting or rubbing between the anode and cathode for the entire length of the lead anodes. Each of the disclosed embodiments of the invention can be installed with the lead anodes in the electrowinning cell. Once the anode insulators of the invention are in place, the removal and reloading of cathodes is greatly facilitated. By avoiding any rubbing of lead from the anode header bars on the cathode as it is removed to harvest copper results in higher grade copper, which in turn leads to increased marketability and profitability of the harvested copper. The described embodiments of the anode insulators of the present invention also can be easily and quickly installed on new anodes before they are loaded into electrowinning cells, and in fact the anodes and anode header bars attached thereto can be stacked conveniently with the anode insulators already installed thereon.

Another advantage of the above-described structures, wherein the legs are composed of cylindrical PVC (polyvinylchloride) tubing is that there is very little contact between the anode and cathode surfaces and the tubing, so, consequently, very little of the active surface of the cathodes and anodes is blocked, and hence there is minimum inteference with the electrolytic process.

Figure 12:
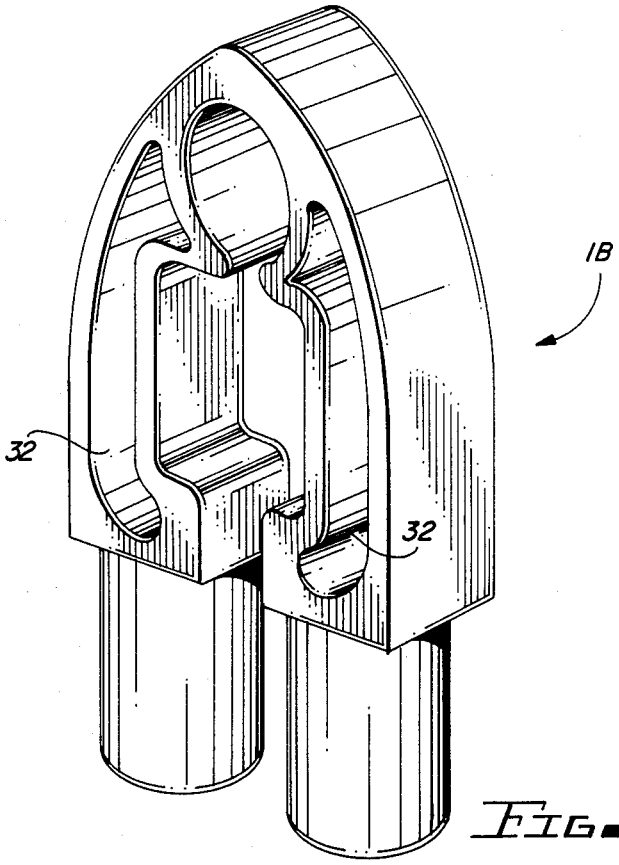
FIG. 12 is a perspective view of an alternate upper section which can be used on the anode insulator of the present invention as an upper section and/or as a lower section.

FIG. 12 shows an alternate embodiment of an upper and/or lower section which can be provided for the anode insulator legs of the present invention. Instead of forming such sections by bending heated PVC tube, as previously described, the upper section 1B of FIG. 12 could be injection molded. The interior could be hollow, with vent holes 32. If manufactured in sufficient volume, use of this upper section would be economical.

While the invention has been described with reference to several particular embodiments thereof, those skilled in the art will be able to make various modifications to the described embodiment of the invention without departing from the true spirit and scope thereof. It is intended that all anode insulators which are equivalent to those described herein in that they perform substantially the same function in substantially the same way to accomplish substantially the same result are the legal equivalence of the claimed devices and are within the scope of the invention. For example, the insulators can be made from other materials than disclosed, such as polypropylene or polyethylene. The insulators may be solid rather than hollow. The lower end of the layers of the insulators could be merely tied together with copper wire, rubber bands, etc.

I claim:

1. An improved anode insulator for use in an electrowinning cell, including a plurality of spaced anodes each supported by an anode header bar, each having a plurality of the improved anode insulators disposed thereon for preventing contact with a plurality of spaced cathodes that are respectively disposed between adjacent anodes, each improved anode insulator comprising:

(a) first and second elongated insulating means disposed along intermediate portions of opposite faces of one of the anodes for preventing any contact between the faces of that anode and adjacent cathodes;

(b) upper connecting means disposed around the top and side portions of the anode header bar supporting that anode and conforming to the shape of the header bar; for preventing contact between the adjacent cathodes and that header bar, the upper connecting means being attached to upper end portions of the first and second elongated insulative means to support the first and second elongated insulating means, the upper connecting means also providing the function of guiding adjacent cathodes between adjacent anodes during lowering of the cathodes to their proper positions between the anodes, wherein the outer surfaces of the upper connecting means do not extend substantially further outward from the anode header bar toward an adjacent anode header bar than the outer surface portions of the first and second elongated insulating means, whereby minimum anode to cathode spacing can be achieved; and (c) lower connecting means for joining the lower end portions of the first and second elongated insulating means and preventing sideways displacement of the first and second elongated means in directions parallel to the faces of that anode, the first and second elongated insulating means being connected together at their end portions so that the first and second elongated insulating means, the upper connecting means, and the lower connecting means form a closed loop.

2. The improved anode insulator of claim 1 wherein the upper connecting means is integral with the first and second elongated insulating means.

3. The improved anode insulator of claim 2 wherein the upper connecting means and the first and second insulating means are composed of PVC tubing.

4. The improved anode insulator of claim 3 wherein the lower connecting means include holes in the lower end portions of the first and second elongated insulating means, and pin connecting means extending through those holes and securely connecting the lower end portions of the first and second elongated insulating means together.

5. The improved anode insulator of claim 3 wherein the lower connecting means includes a U-shaped tube and also includes means for connecting the upper portions of the U-shaped tube to the lower end portions of the first and second elongated insulating means.

6. The improved anode insulator of claim 5 wherein the upper insulating means includes a pair of opposed sloped outer surfaces extending downward and outward from a generally pointed peak and adapted to guide the bottom edge of a cathode along the outer surface of the anode insulator during lowering of the cathode into the electrowinning cell.

7. The improved anode insulator of claim 6 wherein there are no holes or pins extending through the anode for effectuating attachment of the improved anode insulator to the anode.

8. The improved anode insulator of claim 3 wherein the anode header bar supporting that anode includes an elevated portion, the improved anode insulator including upward extending means extending above the portion of the top connecting means surrounding the anode header bar, to a level above the highest level of the elevated portion of the anode header bar to effectuate guiding of the lower edge of a cathode as it is lowered into the electrowinning cell so as to prevent any contact between the cathode and the elevated portion of the anode header bar.

9. The improved anode insulator of claim 3 including a plurality of holes in the first and second elongated members for effectuating passing of electrolytic solution from the electrowinning cell into a hollow interior of the PVC tubing and allowing air to escape from the interior of the PVC tubing.

10. The improved anode insulator of claim 3 wherein the outside diameter of said PVC tubing is approximately three-fourths of an inch to one and one-half inches, and wherein the length of the sections of the PVC tubing of which the first and second insulating means are composed is in the range of 30 to 60 inches.

* * * * *